US010463569B2

(12) United States Patent
Wagner et al.

(10) Patent No.: US 10,463,569 B2
(45) Date of Patent: Nov. 5, 2019

(54) PHARMACEUTICAL PACKAGE

(71) Applicant: Medcomb Holding APS, Copenhagen V (DK)

(72) Inventors: John Wagner, Værløse (DK); Flemming Wagner, Frederiksberg C (DK)

(73) Assignee: MedComb Holding ApS, Copenhagen V (DK)

( * ) Notice: Subject to any disclaimer, the term of this patent is extended or adjusted under 35 U.S.C. 154(b) by 308 days.

(21) Appl. No.: 15/508,440

(22) PCT Filed: Sep. 8, 2015

(86) PCT No.: PCT/DK2015/050270
§ 371 (c)(1),
(2) Date: Mar. 2, 2017

(87) PCT Pub. No.: WO2016/037626
PCT Pub. Date: Mar. 17, 2016

(65) Prior Publication Data

US 2017/0252266 A1 Sep. 7, 2017

(30) Foreign Application Priority Data

Sep. 12, 2014 (DK) ..... 2014 70564
Feb. 19, 2015 (DK) ..... 2015 70092

(51) Int. Cl.

| | |
|---|---|
| ***A61J 1/03*** | (2006.01) |
| ***B65D 75/32*** | (2006.01) |
| ***B65D 77/04*** | (2006.01) |
| ***B65D 77/22*** | (2006.01) |

(52) U.S. Cl.
CPC ..... *A61J 1/035* (2013.01); *B65D 75/327* (2013.01); *B65D 77/0413* (2013.01); *B65D 77/22* (2013.01)

(58) Field of Classification Search
CPC ..... A61J 1/03; A61J 1/035; B65D 75/327; B65D 75/323; B65D 11/12; B65D 75/367; B65D 77/0413
USPC ..... 206/531, 538, 528
See application file for complete search history.

(56) References Cited

U.S. PATENT DOCUMENTS

| | | | | |
|---|---|---|---|---|
| 3,324,996 A * | 6/1967 | Jordt | B65D 83/0463 | 206/531 |
| 3,659,706 A * | 5/1972 | Serrell | B65D 83/0445 | 206/445 |
| 4,593,819 A * | 6/1986 | Will | A61J 1/03 | 206/501 |
| 6,338,408 B1 * | 1/2002 | Anderson | A61J 1/035 | 206/538 |
| 6,679,381 B1 * | 1/2004 | Bush | B65D 43/164 | 206/531 |

(Continued)

FOREIGN PATENT DOCUMENTS

| | | |
|---|---|---|
| JP | 2001-188475 A | 7/2001 |
| WO | WO 2013/041098 A1 | 3/2013 |

OTHER PUBLICATIONS

International Search Report for PCT/DK2015/050270 dated Dec. 15, 2015.

*Primary Examiner* — Steven A. Reynolds
(74) *Attorney, Agent, or Firm* — Knobbe, Martens, Olson & Bear, LLP

(57) ABSTRACT

The present invention relates to a blister pack for pharmaceutical compositions or supplements.

15 Claims, 15 Drawing Sheets

(56) References Cited

U.S. PATENT DOCUMENTS

| | | | | |
|---|---|---|---|---|
| 7,464,819 | B2 * | 12/2008 | Maietta | B65D 83/0463 206/1.5 |
| 7,549,541 | B2 * | 6/2009 | Brozell | B65D 83/0463 206/531 |
| 7,617,935 | B2 * | 11/2009 | Reilley | A61J 7/00 206/1.5 |
| 7,938,265 | B2 * | 5/2011 | Bitner | A61J 1/035 206/536 |
| 8,220,636 | B2 * | 7/2012 | Beecroft | B65D 83/0472 206/1.5 |
| 2003/0168376 | A1 * | 9/2003 | Taneja | B65B 9/045 206/534 |
| 2004/0226853 | A1 * | 11/2004 | Intini | B65D 43/162 206/536 |
| 2006/0138014 | A1 | 6/2006 | Drought et al. | |
| 2011/0127320 | A1 | 6/2011 | Sams et al. | |

* cited by examiner

PHARMACEUTICAL PACKAGE

CROSS REFERENCE TO RELATED APPLICATIONS

This application is a U.S. National Phase Application of PCT International Application Number PCT/DK2015/050270, filed on Sep. 8, 2015, designating the United States of America and published in the English language, which is an International Application of and claims the benefit of priority to Danish Patent Application No. PA 2014 70564, filed on Sep. 12, 2014, and Danish Patent Application No. PA 2015 70092, filed on Feb. 19, 2015. The disclosures of the above-referenced applications are hereby expressly incorporated by reference in their entireties.

FIELD OF THE INVENTION

The present invention relates to a pharmaceutical package for pharmaceutical compositions or supplements such as dietary supplements.

BACKGROUND OF THE INVENTION

In medication, drug or dietary supplement compliance a once-a-day regimen appears to be more effective than a multiple-doses-a-day regimen. Indeed patients more easily are able to follow a single daily medical advice more than multiple daily medical advices.

Multiple packaging combining different pharmaceutical compositions or dietary supplements are thus useful to ensure adherence to an optimal daily regimen, defined daily dose (DDD), or recommended or Prescribed Daily Dose, i.e. a dose based on individual characteristics such as age and/or training habits.

However, combining different pharmaceutical compositions and/or supplements in a common package is not simple as it may lead to undesired reactions or interactions between the chemical compounds present in the different compositions and/or supplements.

In particular, under the development of dietary supplement, the reaction between the bioactive substances in the formulation may be a considerable issue leading to degradation of one or more bioactive substances. This could limit the combination of compositions in the final product, and/or the shelf life period of the product. It is thus challenging to decide on recipe and blending of substances in a final product and still keep good stability.

In general, to avoid direct contact between each formulation, each table/capsule has to be completely separately packaged in different containers, such as bottles. However, this is not convenient for the consumers.

Hence, an improved blister package would be advantageous, and in particular, a blister package facilitating convenient daily dose compliance would be advantageous.

OBJECT OF THE INVENTION

An object of the present invention is to provide a solution for holding several different pharmaceutical formulation or supplements in a single use package.

A further object of the invention is to provide a single use package that is able to hold different pharmaceutical compositions and that is easy to open.

Another object of the present invention is to provide an alternative to the prior art.

It is an object of the present invention to wholly or partly overcome the above disadvantages and drawbacks of the prior art.

In particular, it may be seen as a further object of the present invention to provide a single use package that solves the above mentioned problems of the prior art with a new packaging system comprising a carrier for pharmaceutical composition and a holder of the carrier.

SUMMARY OF THE INVENTION

Multiple dispensing may be very convenient. However, multiple dispensing is not easy to achieve. Multiple access to several stored substances should be achievable in a convenient and easy way, while keeping high-level protection against undesired rupture or against contact between incompatible substances.

The invention is particularly, but not exclusively, advantageous for obtaining access to multiple dispensing as a simple and effective way of facilitating the simultaneous easy access and thus administration of storage incompatible substance particularly when said substances are taken as part of a complex sequential daily therapeutic or dietary regimen.

An advantage of the invention is the ability to facilitate simultaneous easy access and administration of prescription and non-prescription substances as part of a complex regimen.

The above described object and several other objects are intended to be obtained in a first aspect of the invention by providing a carrier for pharmaceutical composition comprising at least two cavities for housing pharmaceutical composition and at least a cover sheet covering the at least two cavities, the cover sheet comprising elements.

In some embodiments the carrier comprises one or more recess.

The cover sheet may cover the one or more recess.

The element may cover the one or more recess.

In some embodiments the recesses are located on an edge of the carrier.

In some other embodiments the recesses are located on more than one edge of the carrier.

Thus recesses may define the shape of at least one of the edge of the carrier.

In some further embodiments, the carrier comprises at least a first and a second portion, wherein the first and second portion are adapted to mutually engage upon folding and/or pressing of the second portion and the first portion onto each other, the second portion when engaged onto the first portion producing a rigid structure.

A rigid structure is herein defined as a structure with the characteristic of being firm, having a certain degree of stiffness, unbendability and inflexibility so as to allow for safe handling in transportation through normal post avoiding undesired rupture.

In some embodiments the first and second portion are pivotally connected to each other.

Pivotally is herein defined as connected in a pivotal manner, e.g. by means of or on a pivot so that it can be turned around along a pivot such as a specific point, axes or edge, e.g. a fold line.

The first and/or second portion may have at least one bevelled edge.

In another aspect of the invention the above described object and several other objects are intended to be obtained by providing a pharmaceutical package comprising: a carrier for pharmaceutical composition; a container for holding the carrier for pharmaceutical composition; wherein the carrier comprises at least two cavities for housing pharmaceutical composition and the carrier comprising at least a cover sheet covering the at least two cavities, the cover sheet comprising elements; and wherein the container comprises at least two pivotally connected halves; wherein at least one of the two pivotally connected halves comprises sidewalls having one or more indentations.

The one or more indentations allow for access to the elements by a user. Thus, when the carrier is contained in the at least one of the two pivotally connected halves the one or more indentations allow for pinching the elements between thumb and another finger of a user.

In some embodiments, when the carrier is contained in the at least one of the two pivotally connected halves, the one or more sidewalls surround the carrier.

Allowing for pinching the elements between thumb and index finger of a user allows in turn the easy removal of the cover sheet or at least part of the cover sheet and thus to effortless access to the content of the cavities protected by the cover sheet.

Pinching the elements refers to squeezing or pressing the elements with a thumb and a finger.

Access to the content of the blister is thus achieved by pinching and peeling off of the cover sheet or at least part of the cover sheet. In that, pinching the elements may also refer to as squeezing and pulling the elements with a thumb and a finger, thus removing at least part of the cover sheet by pulling the elements.

Removal of the cover sheet provide access to multiple cavities thus providing a multiple opening and multiple dispensing of the composition contained in the cavities.

The carrier is formed by folding the at least one of the two pivotally connected halves by 180° into an overlapping configuration so that the carrier halves lie on top of each other. Cavities are thus present on the top and bottom surface of the carrier.

In some embodiments the elements comprise pinchable elements.

A pinchable element is an element that can be squeezed or pressed in between a thumb and a finger of a user, thus allowing for peeling-off and thus removal of the cover sheet.

The elements may comprise tear-off elements, peel-off elements.

In some embodiments the elements may be cuts, strips or are flaps that may have protrusions so as to allow a better grip.

In some embodiments, a cover sheet can be one cover sheet separated in independent portions by a punched through line.

A punched through line, maybe fully or partially punched through the coversheet and/or carrier, thus allowing for removal of part of the cover sheet, while leaving the rest of the cover sheet in place.

Independent portion having independent elements that can be squeezed and pulled independently provide selected access to selected cavities by removing only part, i.e. a portion, of the cover sheet, leaving other parts intact.

In some embodiments the carrier comprises one or more recesses and wherein the one or more sidewalls indentation and the one or more carrier recess are matching.

An indentation is a notch, a cut or a recess on the sidewalls of the at least one of the two pivotally connected halves. Indentations on the container sidewalls and carrier recess may be matching, i.e. may have a matching size allowing the user to pinch the element and thus remove the cover sheet to access the pharmaceutical composition or supplement contained in the cavities. Indentations on the sidewalls of the container and carrier recesses may be mirroring in shape, i.e. creating a hollow passage between the sidewalls of the container or lid and the carrier sheet, thus allowing the user to pinch the element and thus remove the cover sheet to access the pharmaceutical composition or supplement contained in the cavities.

The indentations on the sidewalls and the recesses on the carrier are adapted to create a hollow passage between the sidewalls of the container and the carrier so as to allow the user to pinch the element and thus remove the cover sheet to access the pharmaceutical composition contained in the cavities.

The size or dimension of the indentations on the sidewalls is adapted to allow to quickly and easily grab, thus take and hold the element, such as a gripping element of the cover sheet.

In some embodiments, the one or more sidewalls indentations and the one or more carrier recesses are complementary, i.e. complementary in shape so as to allow quickly and easily grab, thus take and hold the element, such as a gripping element of the cover sheet.

In some further embodiments at least one of the two pivotally connected halves is a carrier holder.

The carrier holder may have one or more indentation on its sidewalls allowing for pinching the elements between thumb and another finger of a user.

In some embodiments the at least one of the two pivotally connected halves comprise a first and a second endwall wherein the first endwall comprises at least one protrusion extending towards the second endwall.

The at least one protrusion may be complementary to the at least one bevelled edge.

The pharmaceutical package is adapted so that the carrier can be positioned inside the container in a desired direction, i.e. wherein the bevelled edge and the corresponding protrusion matches allowing for positioning of the carrier in a desired and predeterminate position.

In some further embodiments the other one of the two pivotally connected halves is a lid.

The at least one cover sheet is thus protected by at least one lid.

A lid may be a removable film, foil, rigid sheet, panel or a hollow body, which protects the cover sheet from undesired rupture.

The at least one lid may be made of plastic, plastic laminates, plastic/paper laminates or plastic/metal foil laminates or metal. Non-limiting exemplary suitable plastics for the carrier are laminates containing PVC, polyamides, polyolefins, polyesters, polycarbonates, teflon and combinations thereof. The at least one lid may be also made of material which is at least partially transparent in visible range of light as to allow for visual inspection pharmaceutical composition contained in the cavities of the carrier.

In some embodiments the at least one lid is fully removable. In other embodiments the at least one lid may be opened through a rotation of the lid along at least one rotational joint located on the container.

The carrier holder and the lid may be pivotally connected.

In some other embodiments the at least one lid is or comprise at least one adhesive element, such as a long thin piece of plastic, cloth or paper with binding capabilities, e.g. a piece of tape. In those embodiments, access to the cover and carrier can be obtained through a rotation of the lid along one of the edges of the carrier.

In some embodiments the at least one rotational joint may be a hinge. In some embodiments the at least one rotational joint may be a pivot hinge. In some other embodiments the at least one rotational joint may be a pivot hinge with springs means for producing of a counter rotation moment. The presence of a pivot hinge allows for opening of the lid by a lateral rotation movement. In this embodiment closing of the lid is then obtained by the overlay of the lid onto the carrier holder by the opposite lateral rotation movement.

In some other embodiments the at least one lid is or comprise at least one hollow body, such a sleeve.

In some embodiments the at least one cover sheet may be protected by different lid system, for example access to the at least one cover sheet may be obtained through a slidable windows/shutters system.

The carrier may hold one or more different kind of pharmaceutical compostions or supplements.

The carrier may be supplied separately from the holder. Refill carriers may be supplied accordingly having different kind and amounts of pharmaceutical compositions or supplements.

A pharmaceutical composition herein referred may comprise any biologically active substance, without limitation.

Pharmaceutical composition may be prescription or non-prescription substances or excipients for use in prescription or non-prescription substances.

Pharmaceutical composition may be a medicine or a supplement such as a dietary supplement.

Pharmaceutical composition may be prescription or non-prescription substances such as vaccines.

Non-prescription substances can be a vitamin or derivative thereof, or a mineral compound or derivative thereof.

Pharmaceutical composition herein referred may take any form, and combinations thereof. Examples of such forms include, without limitation, chewable tablet, quick dissolve tablet, effervescent tablet, reconstitute powder, elixir, liquid, solution, suspension, emulsion, tablet, multi-layer tablet, bi-layer tablet, capsule, soft gelatine capsule, hard gelatine capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatine, cereal, cereal coating, animal feed or combinations thereof. The preparation of any of the above forms may be performed by techniques and methods well known and readily available to persons of ordinary skill in the art.

The first and other aspects or embodiments of the present invention may each be combined with any of the other aspects or embodiments. These and other aspects of the invention will be apparent from and elucidated with reference to the embodiments described hereinafter.

BRIEF DESCRIPTION OF THE FIGURES

The pharmaceutical package according to the invention will now be described in more detail with regard to the accompanying figures. The figures show one way of implementing the present invention and is not to be construed as being limiting to other possible embodiments falling within the scope of the attached claim set.

DETAILED DESCRIPTION OF AN EMBODIMENT

Figure 1:
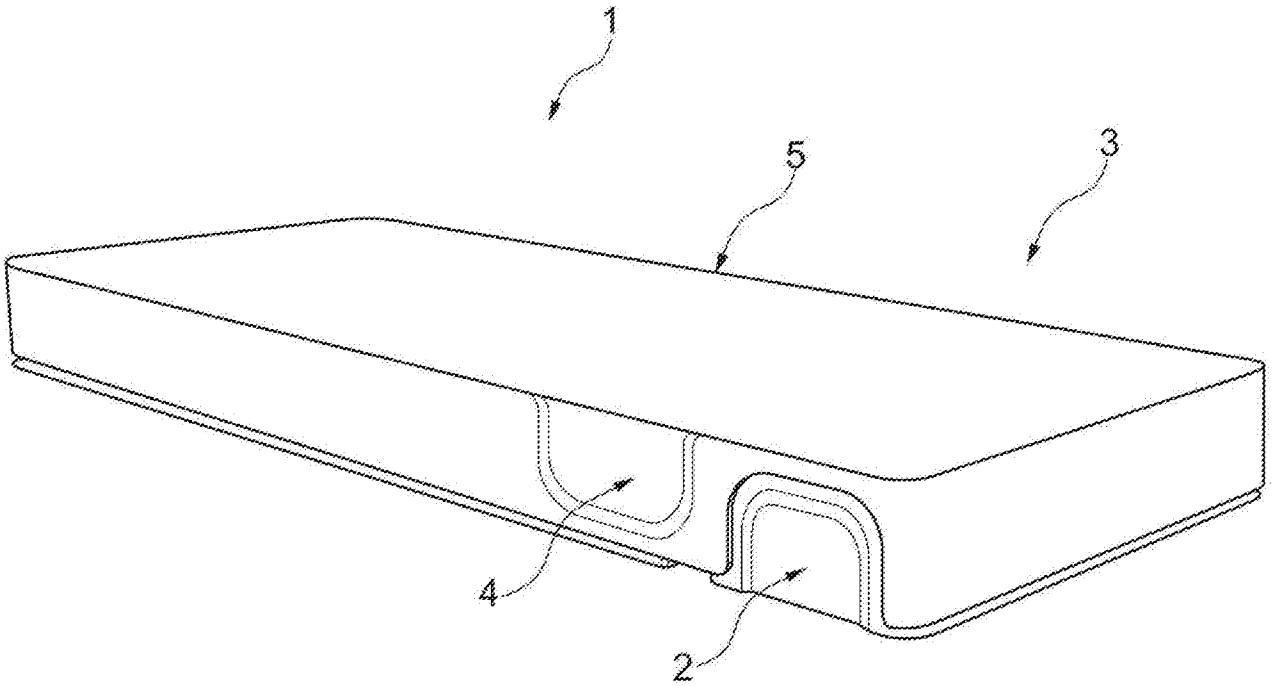
FIG. 1 shows a picture of the schematically 3-dimensional view of a single use pharmaceutical package in its closed state having two means for opening located on the longest and opposite sides of the according to some embodiments of the invention.

FIG. 1 shows a picture of the schematically 3-dimensional view of a single use pharmaceutical package 1 in its closed state. Package 1 shows opening elements 2 and 3 (not visible) located on the longest and opposite side of the package. FIG. 1 shows also gripping elements 4 and 5 (not visible) located on the longest and opposite side of the package. The gripping elements 4 and 5 and the opening elements 2 and 3 are located conveniently close to each other. The gripping elements may have the same size and shape of the opening elements thus providing a degree of child safety as children will be confused on which one of the elements is the opening element, thus hindered from opening the package.

In general, the package and/or the container and/or the lid may comprise functional and not functional elements having the same size and shape to provide a degree of child protection.

Figure 2:
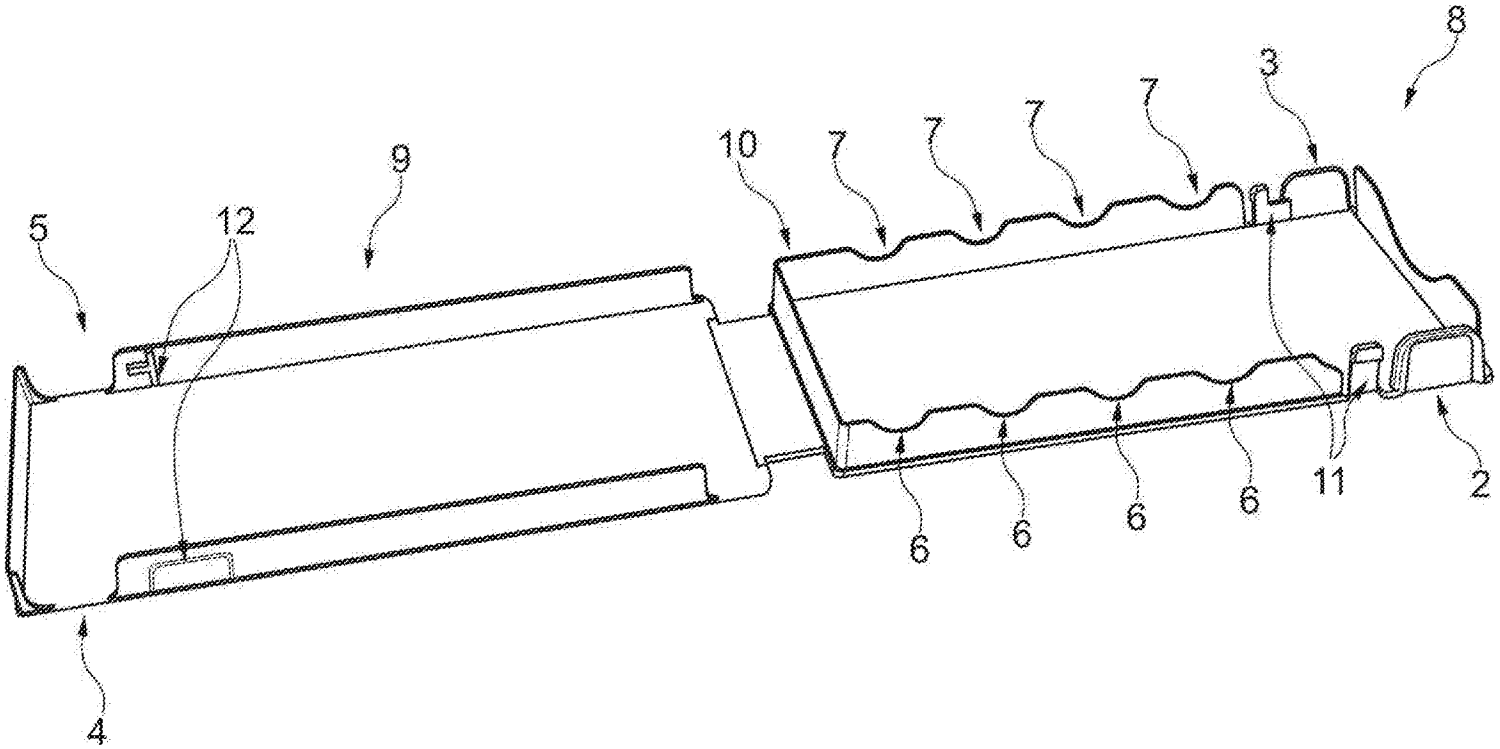
FIG. 2 shows a picture of the schematically 3-dimensional view of a single use pharmaceutical package in its open state when the carrier for pharmaceutical composition has been removed according to some embodiments of the invention.

FIG. 2 shows a picture of the schematically 3-dimensional view of a single use pharmaceutical package 8 in its open state when the carrier for pharmaceutical composition has been removed.

The container 8 comprises at least two pivotally connected halves, i.e. a lid 9 and a holder 10. Both may comprise sidewalls with one or more indentations. FIG. 2 shows the holder sidewalls having indentations 6 and 7.

Indentations 6 and 7 have a curved shape. However, indentations may have any shape, size or dimension allowing for finger access to the cover sheet covering the cavities of the carrier. Indentation is thus adapted to allow a finger to grab a gripping element present on at least part of the cover sheet.

The container 8 may be a casing such as a box made of plastic material, such as a hard polymer.

The lid 9 has the function of closing the container and protecting the contained carrier for pharmaceutical compositions. Lid 9 and holder 10 comprise opening elements with members 11 on the holder 10 that mutually engage with members 12 on the lid 9 upon folding and/or pressing of the lid 9 onto the holder 10.

Figure 3:
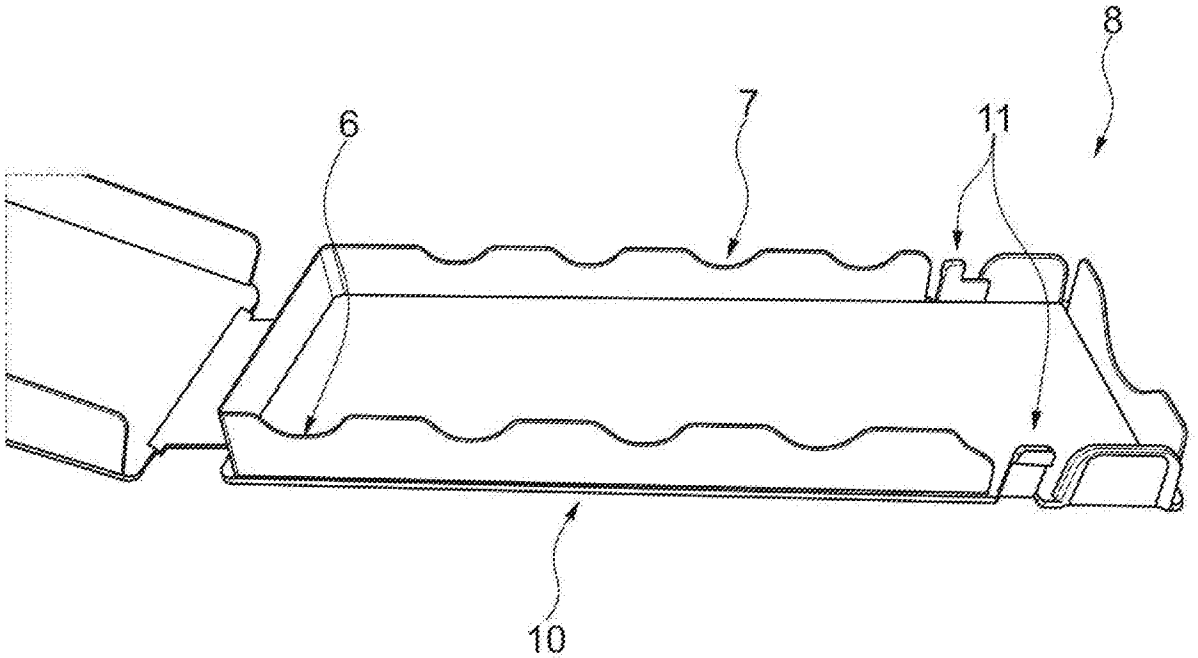
FIG. 3 shows a photo of the single use pharmaceutical package in its open state as depicted in FIG. 2.

FIG. 3 shows a photo of the single use pharmaceutical package 8 in its open state as depicted in FIG. 2.

Figure 4:
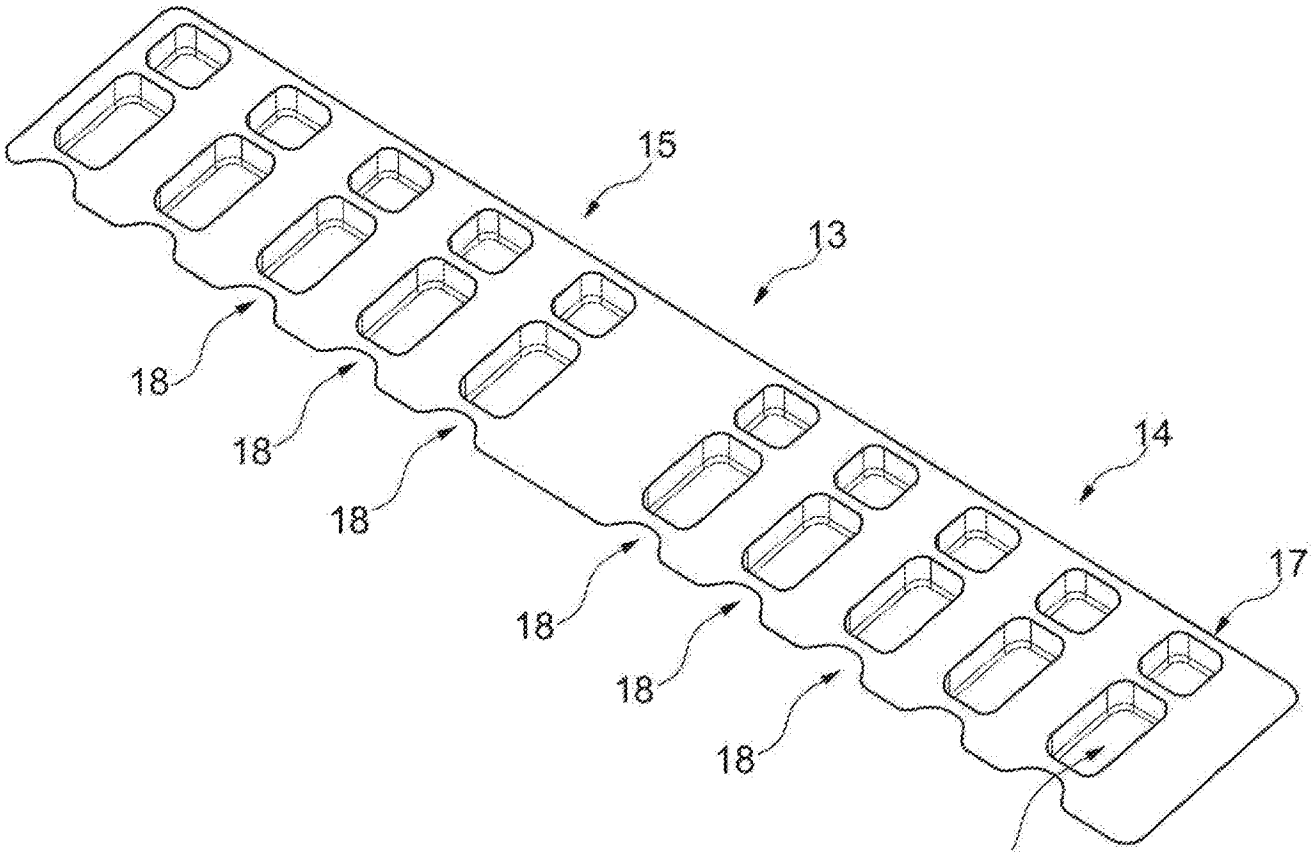
FIG. 4 shows a picture of the schematically 3-dimensional view of the top surface carrier in its unfolded state according to some embodiments of the invention.

FIG. 4 shows a picture of the schematically 3-dimensional view of the top surface carrier 13 in its unfolded.

The carrier 13 comprises at least a first 14 and a second portion 15. The first 14 and second portion 15 are adapted to mutually engage upon folding and/or pressing of said second portion 15 and said first portion 14 onto each other. Cavities 16 and 17 have dimensions and sizes so as to accommodate one or more pharmaceutical compositions. For example, FIG. 4 shows a smaller cavity 17 where one pharmaceutical composition, e.g. in the form of capsule containing a liquid may be contained and a larger cavity 16, where more than one pharmaceutical composition, in the form of tables, may be contained.

The carrier 13 comprises recesses 18 on the edge of the carrier 13. Recesses may be on one or both side edges.

The carrier 13 is generally made out of a thermoformed plastic sheet.

Figure 5:
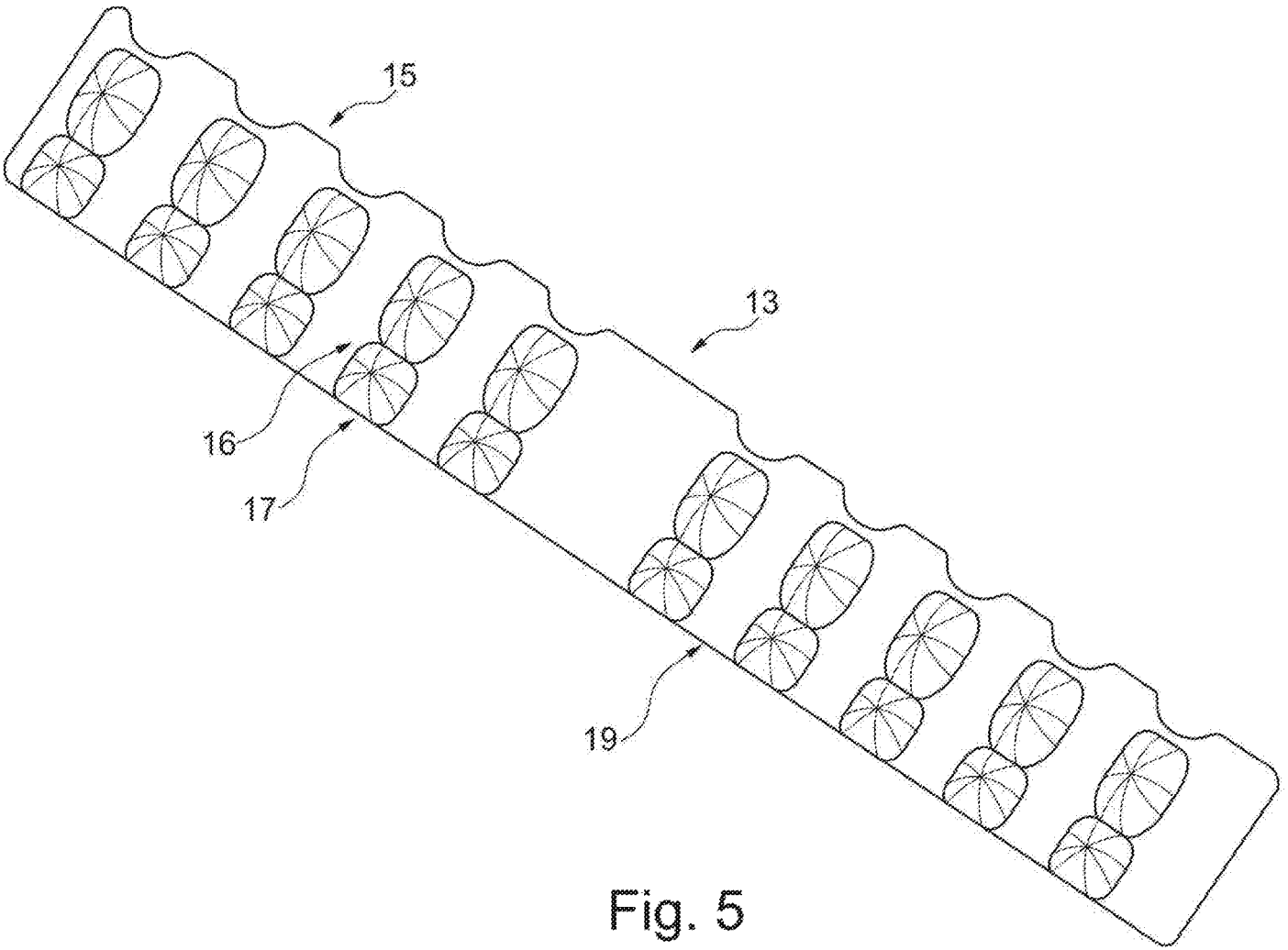
FIG. 5 shows a picture of the schematically 3-dimensional view of the bottom surface of the carrier in its unfolded state according to some embodiments of the invention.

FIG. 5 shows a picture of the schematically 3-dimensional view of the bottom surface of the carrier 13 in its unfolded state.

It can be seen that cavities 16 and 17 on the first portion 15 have size, dimension and shape that fit in the spaces 19 between other cavities of the second portion 14, so as to engage by interference fit between the other cavities of the second portion 14. Thus, by folding the first portion 15 onto the second portion 14 a rigid structure is produced.

Figure 6:
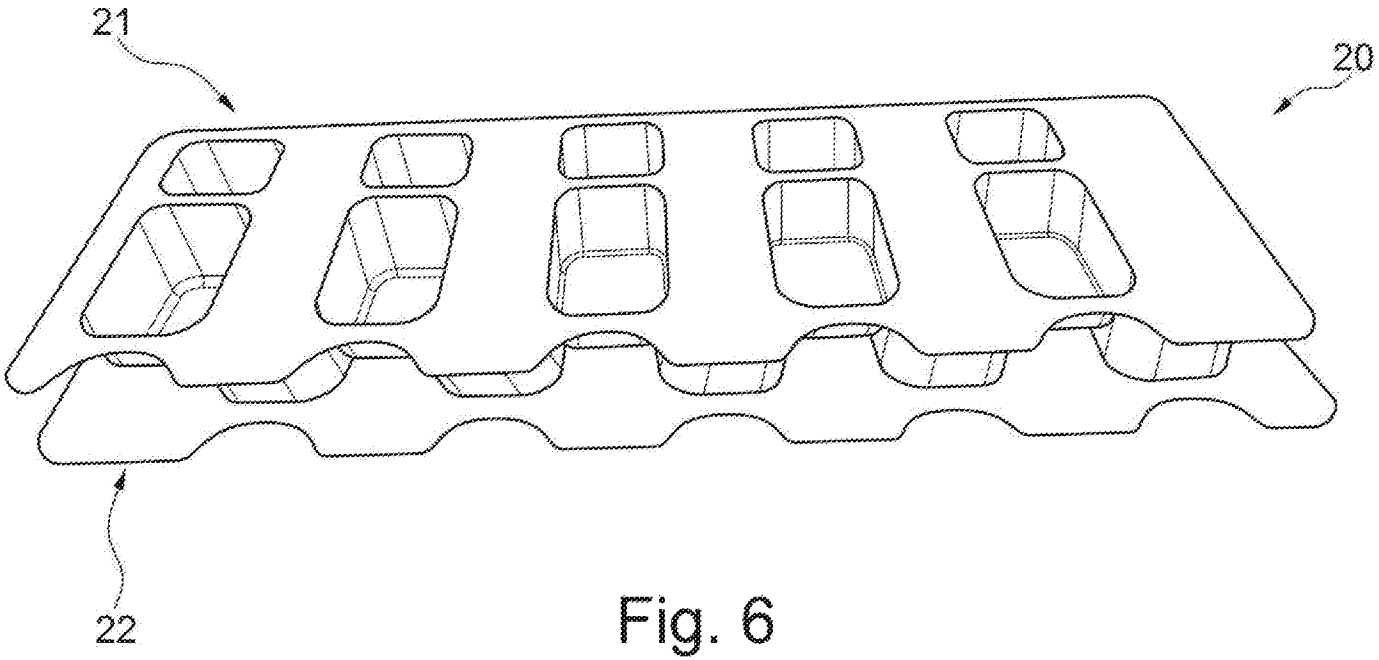
FIG. 6 shows a photo of the carrier in its folded state according to some embodiments of the invention.

FIG. 6 shows a photo of the carrier 20 in its folded state. Easy folding of the first portion 21 into the second portion 22, is possible as cavities of the first and second portion have complementary shapes. Thus, cavities on a first carrier portion are adapted to engage in an interference fit with cavities on a second carrier section when the carrier is folded.

Two complementary shapes can be combined together so that their surfaces mutually engage, e.g. plug-socket or key-lock.

An interference fit, also referred to as a press fit, provides fastening between two carriers simply by friction after the carriers, e.g. the complementary shapes of the cavities, are pushed in contact.

In some embodiments the cavities may have protrusions engaging by interlocking or by interference fit upon folding and/or pressing of the first and the second carrier portion onto each other.

FIG. 6 shows that the carrier 20 has recesses on its edge, which are on the same side of the carrier, whether the carrier is in its folded or unfolded state. Recesses are conveniently located on the same side of the carrier, while indentations are located on both of the longest and opposite sides of the holder. When the pharmaceutical composition contained in the cavities of the top surface of the carrier have been used, the carrier can lifted from the holder, turned by 180° and re-inserted in the holder. The bottom surface of the carrier becomes thus accessible and the cover sheet covering the bottom surface of the carrier gets accessible thought the indentation located on the opposite side of the holder.

Figure 7:
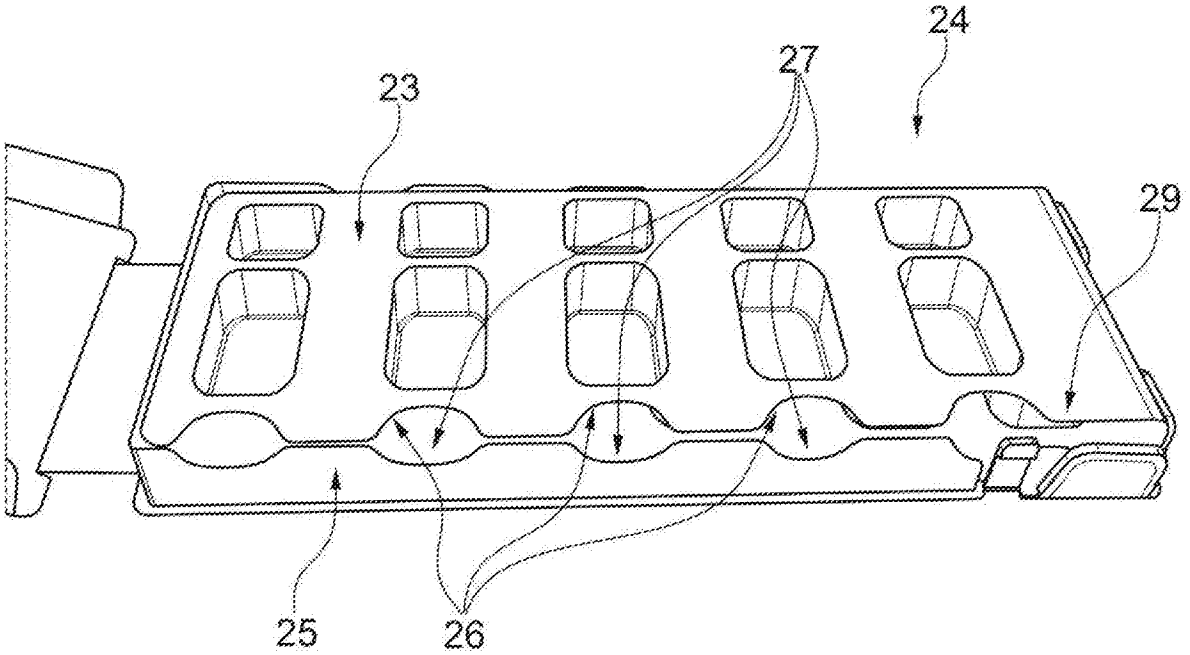
FIG. 7 shows a picture of the schematically 3-dimensional view of the carrier in its folded state contained in the holder according to some embodiments of the invention.

FIG. 7 shows a photo of the package 24 where the carrier 23 in its folded state contained in the holder 25.

Recesses 26 on the carrier 23 are matching with the indentations 27 on the sidewalls of the holder 25. This allow for a finger, such as a thumb to enter the opening created in between the indentations 27 and the recesses 26. When the carrier 23 contains pharmaceutical composition, a cover sheet (not shown) covers and protect the pharmaceutical composition and reach the edge 29 of the carrier 23, thus covering also the recesses 26.

Figure 7A:
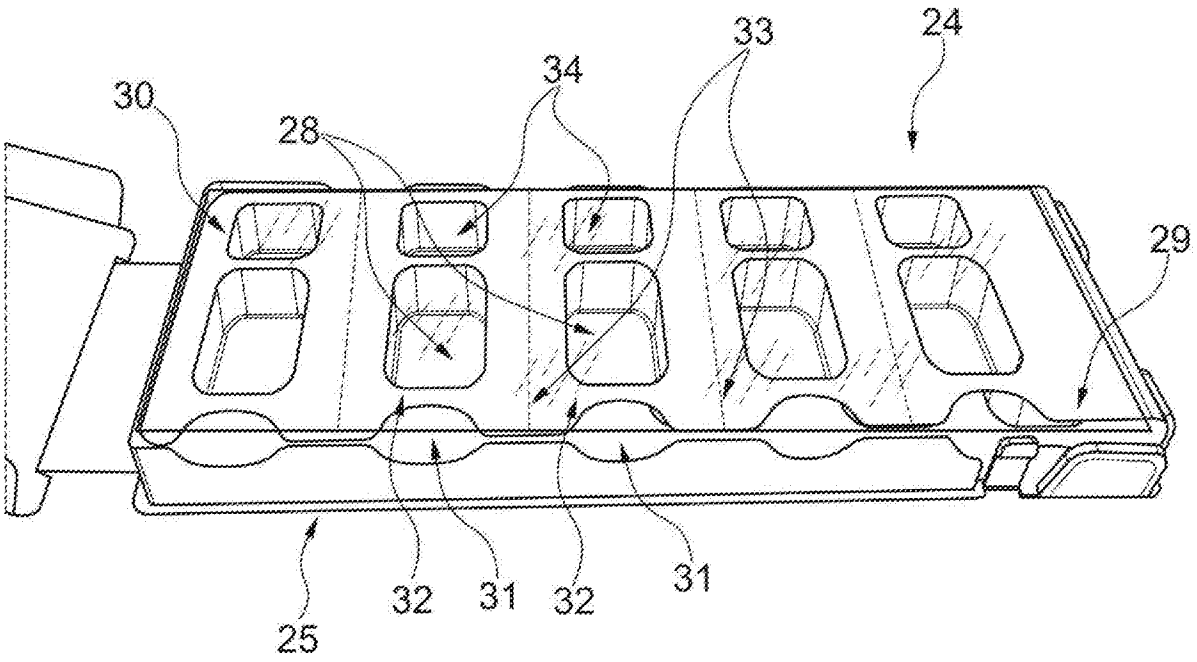
FIG. 7*a* shows the package of FIG. 7 where a cover sheet has been outlined onto the carrier.

FIG. 7*a* shows the package 24 of FIG. 7 where a cover sheet 30 has schetched onto carrier 23. Cover sheet 30 reaches edge 29 and covers recesses 26.

The openings 31 defined by indentations 27 and cover sheet 30 covering recesses 26 allow for pinching of an elements 32 between thumb and another finger of a user.

Punched lines 33 allow for multiple opening of cavities 34 and 28, while the other cavities remain sealed.

Figure 7B:
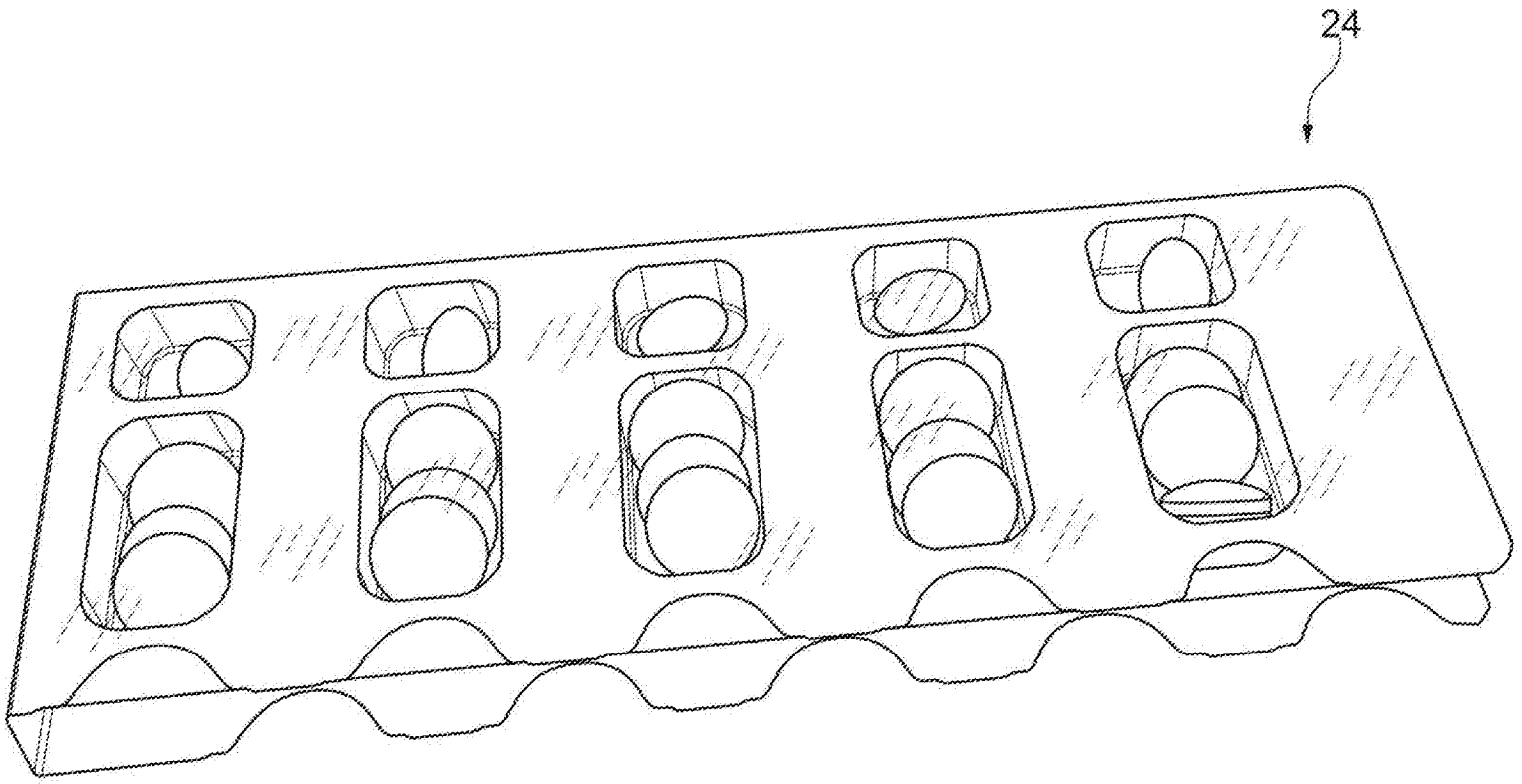
FIG. 7*b* shows the package of FIGS. 7 and 7*a* refilled with different pharmaceutical compositions protected by a transparent cover sheet.

FIG. 7*b* shows the package 24 wherein one of the cavities is filled with three tablets while the other cavity is filled with a capsule containing a liquid. The tables and capsules are protected by a transparent cover sheet.

Figure 7C:
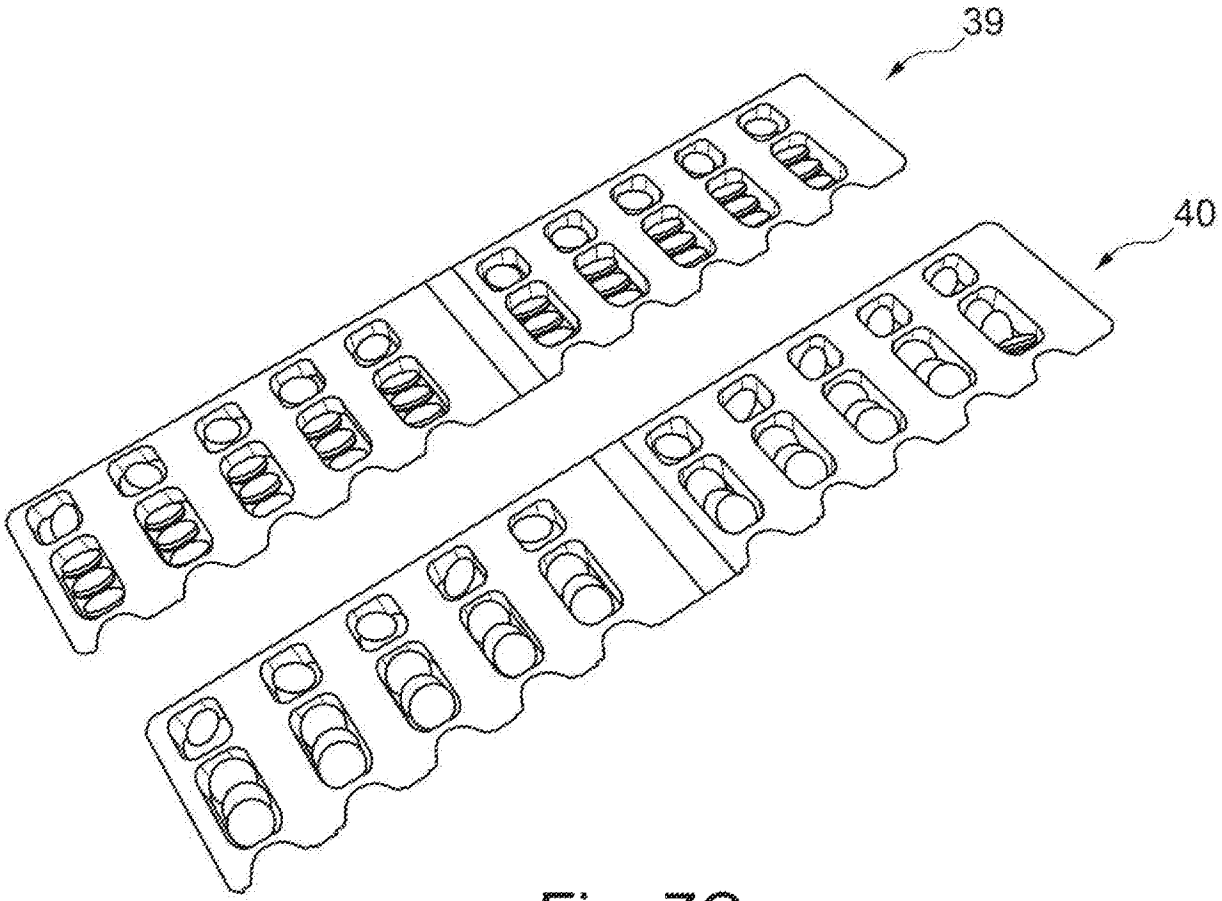
FIG. 7*c* shows the package of FIG. 7*b* in its unfolded state.

FIG. 7*c* shows the packages 39 and 40 in their unfolded state. It can be noticed that the positioning of the three tables in the two packages is different according to different filling procedures.

Figure 8:
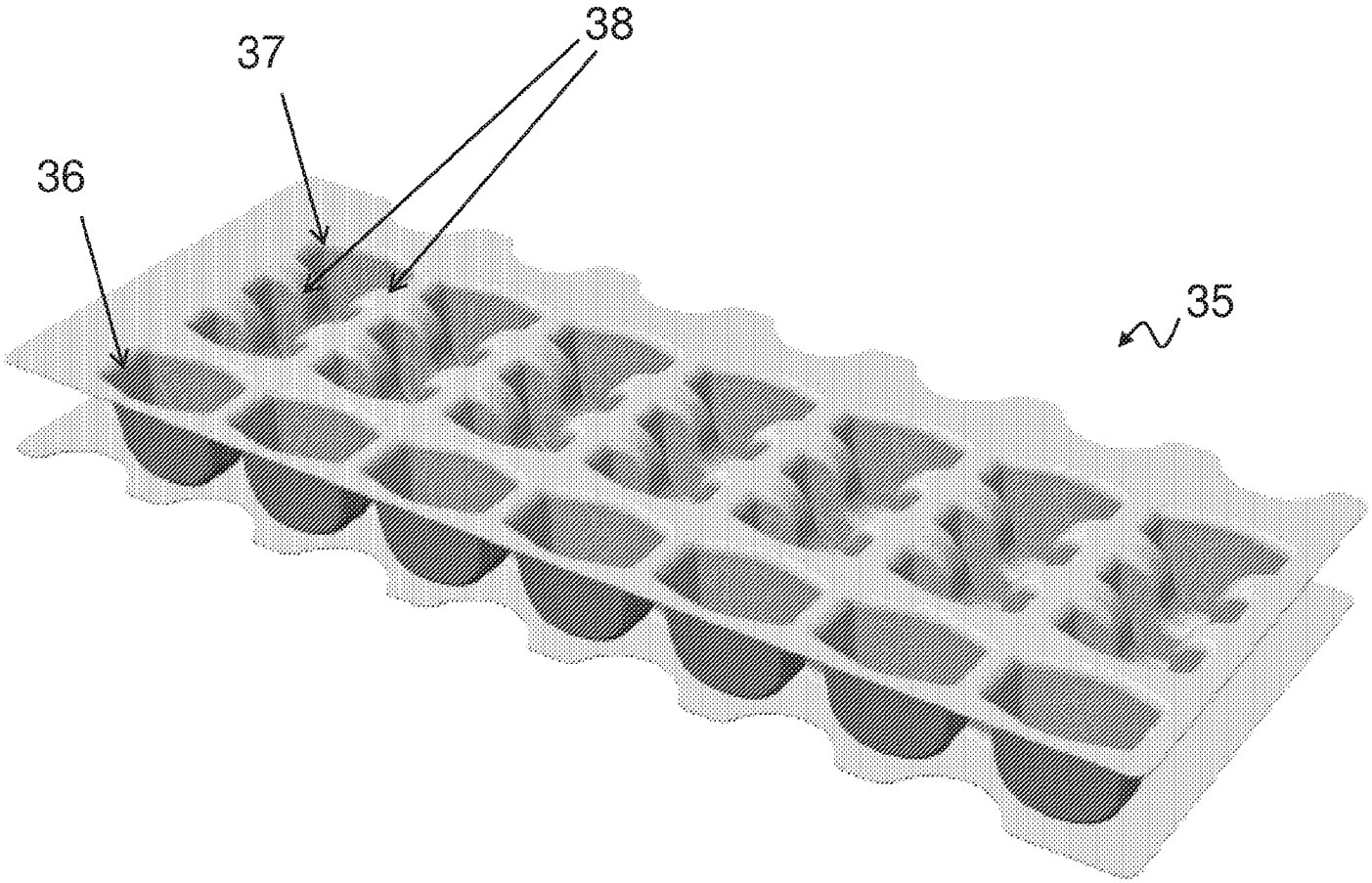
FIG. 8 shows a picture of the schematically 3-dimensional views of a carrier of a single use pharmaceutical package according to some embodiments of the invention.

FIG. 8 shows a picture of the schematically 3-dimensional views of a carrier 35 where at least one cavity has a multicompartment feature. Carrier 35 has cavities 36 and 37. The space inside cavity 37 is separated by separations 38, such as partial walls 38. This ensures physical separation inside a single cavity between different pharmaceutical compositions in the form, e.g. of tablets.

Separation walls 38 have a dimension, i.e. a highest that is lower than the cavity depth. Thus, the number of sealing points required between the carrier surface and the cover sheet may be reduced compared to a carrier with multiple cavities.

A carrier having multicompartments cavities has the advantage of allowing easy access to multiple pharmaceutical compositions that are stored in a way in which physical contact between pharmaceutical composition is still hindered.

Figure 9:
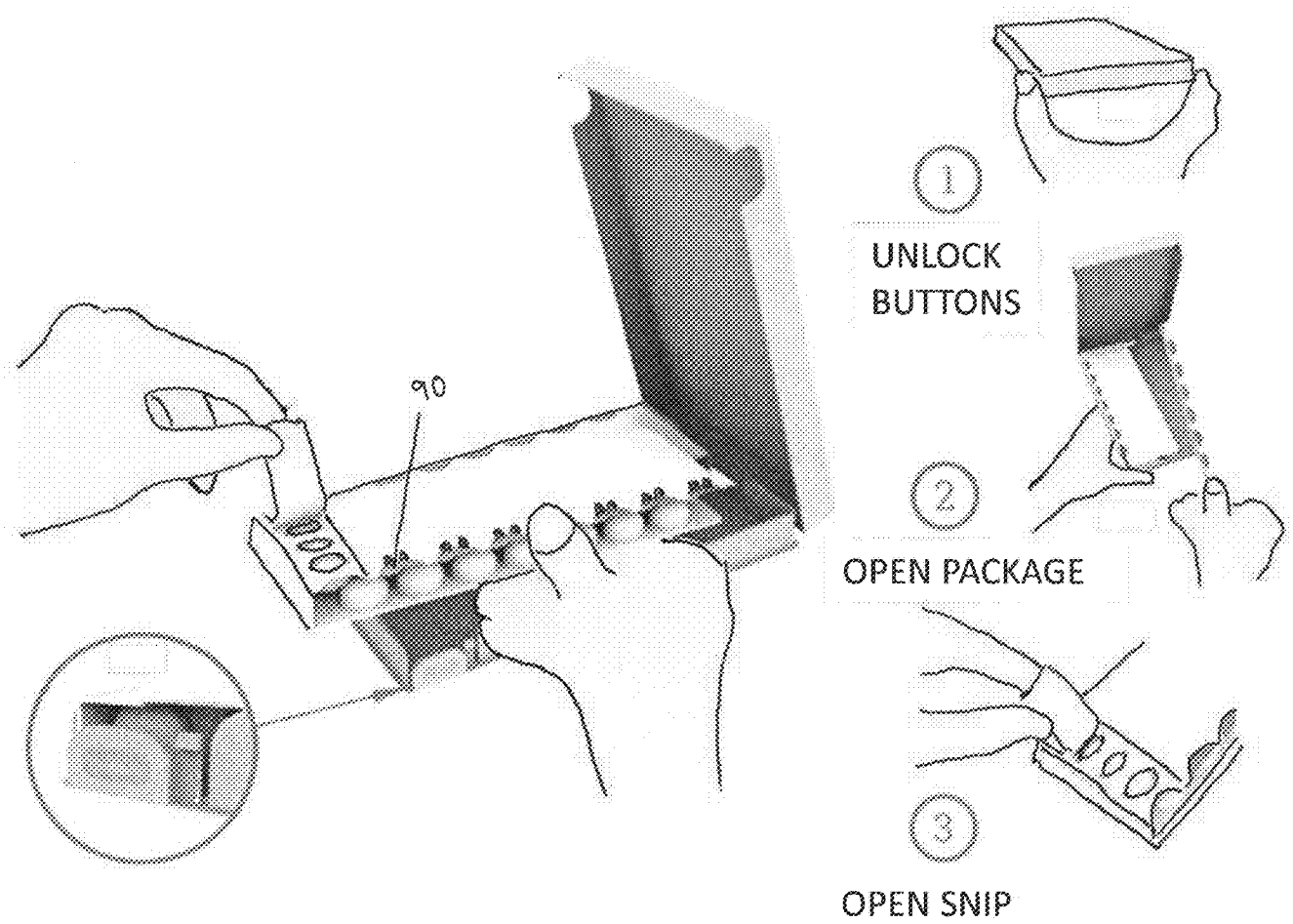
FIG. 9 shows a way to use the package and get access to the content of the container according to some embodiments of the invention.

FIG. 9 shows a way to use the package and get access to the content of the container according to some embodiments of the invention.

To open the pharmaceutical package, the opening means, such as unlock buttons may be pushed so as to open the container. The carrier may be removed and access to the tables can be achieved by removal of a strip. This may be convenient when the holder does not have indentation along its side walls. Direct access to the content of the cavities may be achieved by direct removal of the strip element or part of the cover sheet while the carrier is contained in the holder, due to the presence of indentations, according to some other embodiments of the invention. The elements of the cover sheet shown in this exemplary embodiment have flaps 90 that comprise protrusions configured to allow for a better grip.

Figure 10:
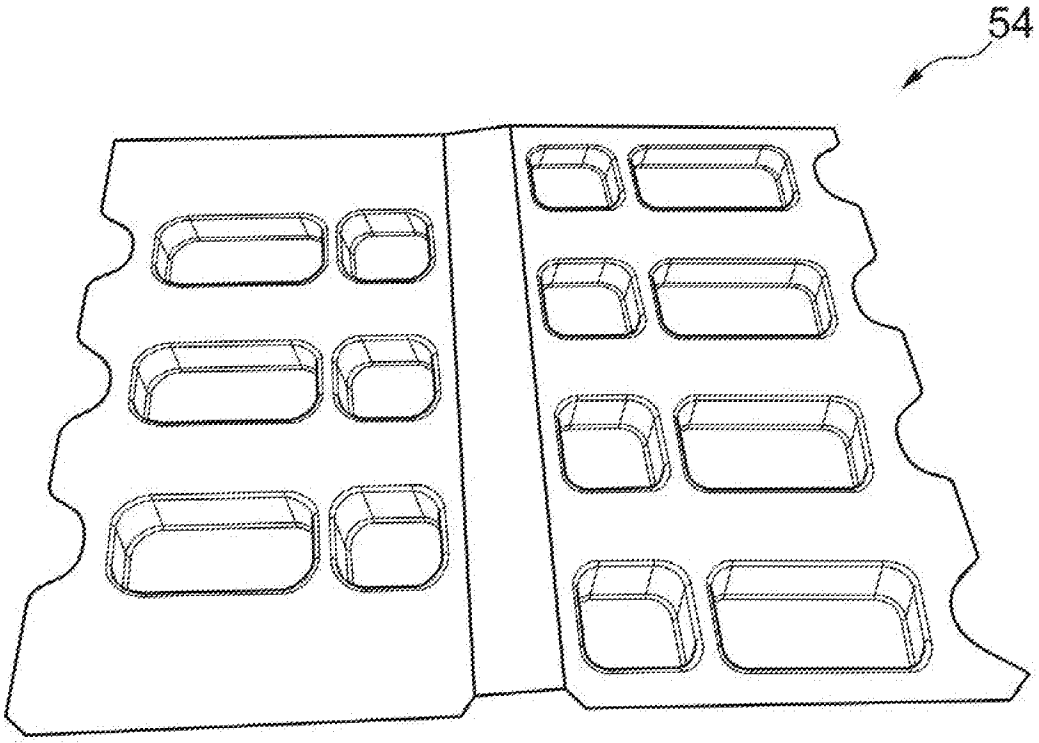
FIG. 10 shows a photo of the carrier in its unfolded state according to some embodiments of the invention.

FIG. 10 shows a photo of the carrier in its unfolded state according to some embodiments of the invention.

Figure 11:
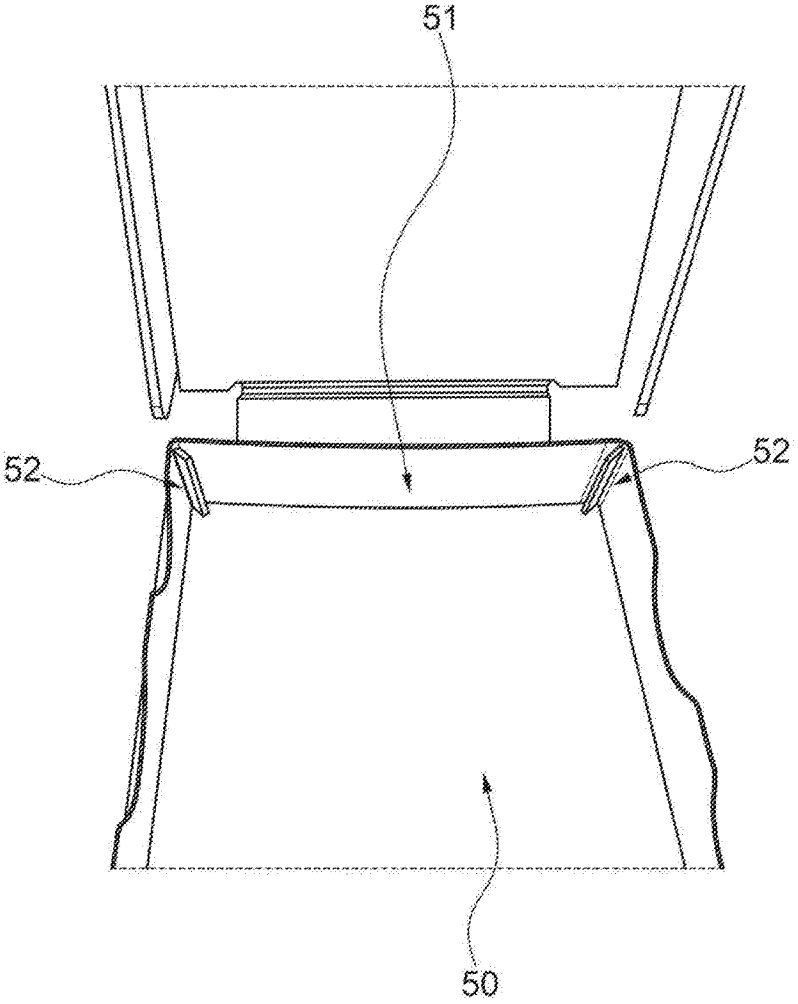
FIG. 11 shows a photo of the container for holding the carrier, according to some embodiments of the invention.

FIG. 11 shows a photo of the container for holding the carrier, according to some embodiments of the invention.

FIG. 11 shows that the one of the two pivotally connected halves 50 of the container comprises a first endwall 51 that comprises two protrusions 52 extending towards the second endwall.

Figure 12:
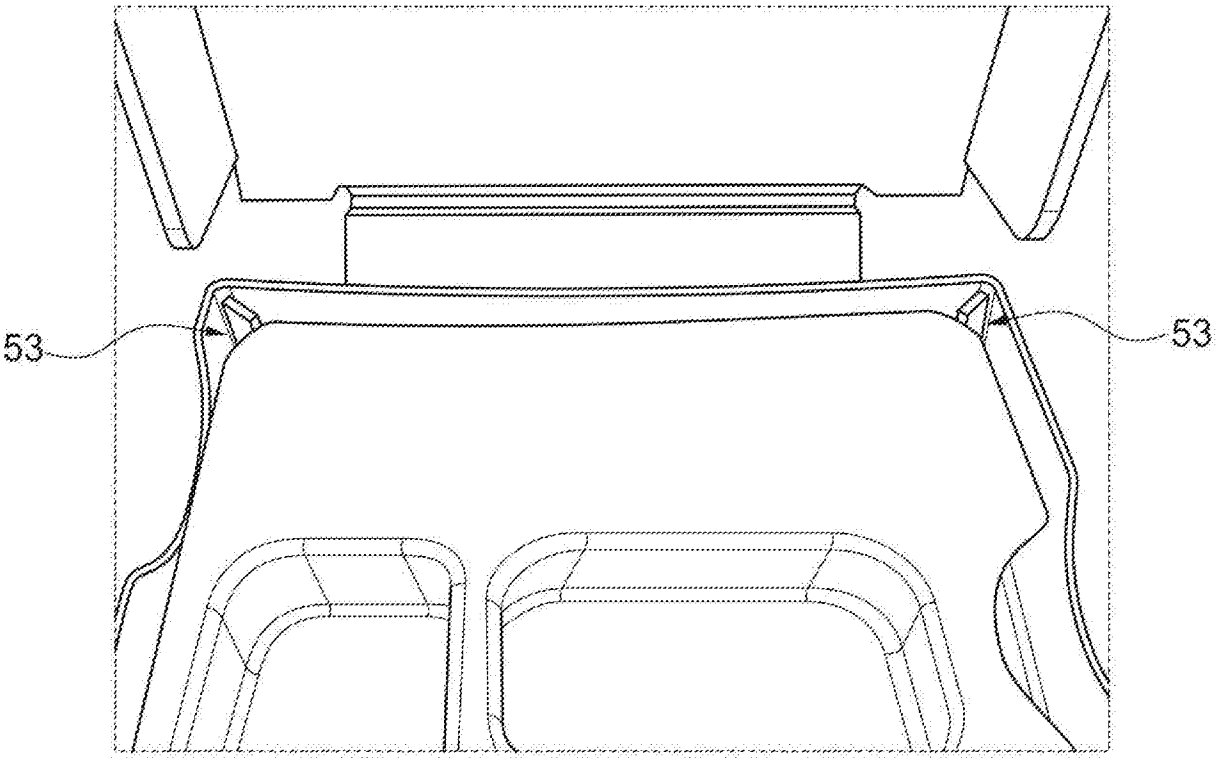
FIG. 12 shows a photo of the package where the carrier is inserted into the container, according to some embodiments of the invention.

FIG. 12 shows a photo of the package where the carrier is inserted into the container, according to some embodiments of the invention.

FIG. 12 shows that the protrusions 52 may be complementary to bevelled edges 53.

Thus, the pharmaceutical package is adapted so that the carrier 54 when folded can be positioned inside the container in a desired direction, i.e. wherein the bevelled edges 53 and the corresponding protrusions 52 match allowing for positioning of the carrier 54 in a desired and predeterminate position.

This has the advantage that the carrier containing pharmaceutical compositions or supplements may be positioned only in a desired direction thus allowing for perfect match between indentations on the sidewalls of the container and recesses on the edge of the carrier. In this way a user will be able to easily pitch elements of the cover sheet for removing the cover sheet and access the cavities housing pharmaceutical compositions or supplements.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A pharmaceutical package comprising:

a carrier for a pharmaceutical composition comprising at least two cavities for housing the pharmaceutical composition and at least a cover sheet covering said at least two cavities, said cover sheet comprising elements; wherein said carrier further comprises at least a first portion and a second portion, wherein said first and second portion are configured to mutually engage upon folding and/or pressing of said second portion and said first portion onto each other, said second portion when engaged onto said first portion producing a rigid structure; wherein said first and/or second portion has/have at least one bevelled edge;

a container configured to hold said carrier for a pharmaceutical composition; wherein said container comprises at least two pivotally connected halves;

wherein at least one of said two pivotally connected halves comprises sidewalls having one or more indentations, said carrier comprising one or more carrier recesses and, wherein said one or more indentations and said one or more carrier recesses are complementary in shape;

and when said carrier is contained in said at least one of said two pivotally connected halves, said one or more indentations allows for pinching said elements between a thumb and another finger of a user;

wherein at least one of said two pivotally connected halves comprise a first and a second endwall, wherein said first endwall comprises at least one protrusion extending towards said second endwall; and wherein said at least one protrusion is complementary to said at least one bevelled edge.

2. The pharmaceutical package according to claim 1, wherein said one or more indentations match said one or more carrier recesses of said carrier.

3. The pharmaceutical package according to claim 1, wherein, when said carrier is contained in said at least one of said two pivotally connected halves, said sidewalls surround said carrier.

4. The pharmaceutical package according to claim 1, wherein at least one of said two pivotally connected halves is a carrier holder.

5. The pharmaceutical package according to claim 4, wherein the other one of said two pivotally connected halves is a lid.

6. The pharmaceutical package according to claim 1, wherein said cover sheet covers said one or more carrier recesses.

7. The pharmaceutical package according to claim 1, wherein said elements cover said one or more carrier recesses of said carrier.

8. The pharmaceutical package according to claim 1, wherein said one or more carrier recesses are located on an edge of said carrier.

9. The pharmaceutical package according to claim 1, wherein said one or more carrier recesses are located on more than one edge of said carrier.

10. The pharmaceutical package according to claim 1, wherein said elements comprise pinchable elements.

11. The pharmaceutical package according to claim 1, wherein said elements comprise tear-off elements.

12. The pharmaceutical package according to claim 1, wherein said elements comprise peel-off elements.

13. The pharmaceutical package according to claim 1, wherein said elements are cuts.

14. The pharmaceutical package according to claim 1, wherein said elements are strips.

15. The pharmaceutical package according to claim 1, wherein said elements are flaps that comprise protrusions configured to allow for a better grip.

* * * * *